United States Patent [19]

McClellan

[11] 4,026,690

[45] May 31, 1977

[54] FORMING TUBE FOR WINDING GLASS FIBERS AND METHOD FOR USING SAME

[75] Inventor: Walter L. McClellan, Minerva, Ohio

[73] Assignee: J.C. Baxter Co., Minerva, Ohio

[22] Filed: June 22, 1976

[21] Appl. No.: 698,748

[52] U.S. Cl. ..... 65/2; 65/3 R; 65/11 W; 93/77 CL; 138/150; 156/175; 156/195; 229/4.5; 229/93; 242/118.32; 428/36; 428/172

[51] Int. Cl.[2] ..... C03B 37/02

[58] Field of Search ..... 65/2, 11 W, 3 R; 242/118.32; 138/150; 93/77 CL, 80; 229/93, 4.5; 156/195, 175; 428/36, 172

[56] References Cited

UNITED STATES PATENTS

| | | | |
|---|---|---|---|
| 2,767,741 | 10/1956 | Knowland et al. | 242/118.32 X |
| 3,429,522 | 2/1969 | Cunningham et al. | 242/118.32 |
| 3,451,433 | 6/1969 | Cunningham et al. | 242/118.32 X |
| 4,888,043 | 5/1959 | Reid | 229/4.5 X |

FOREIGN PATENTS OR APPLICATIONS

| | | | |
|---|---|---|---|
| 704,096 | 2/1954 | United Kingdom | 156/195 |

*Primary Examiner*—Robert L. Lindsay, Jr.

[57] ABSTRACT

A strong, flexible glass fiber carrier and a method of making glass fiber using such a carrier wherein the carrier is of a helically wound forming tube construction for carrying glass fiber thereon in generally circular windings during glass fiber processing, the tube being characterized by having good wet strength and resistance to heat and centrifugal forces. The helically wound tube has a helically wound inner ply having a spiral joint, preferably a spiral butt joint, at least one helically wound intermediate ply having a spiral overlapped joint, a helically wound outer ply having a spiral overlapped joint, and a release coating on the outer ply. The spiral overlapped joint of the outer ply is stacked, or positioned, above the spiral joint of the inner ply to reinforce the latter; the spiral overlapped joint of the intermediate ply(s) is (are) staggered from the other joints of the tube. In the method of making glass fiber, a glass fiber strand is wound around the forming tube and further processed. At the end of the processing, the forming tube is partially collapsed and extracted from the interior of the circularly wound glass fiber.

10 Claims, 5 Drawing Figures

FORMING TUBE FOR WINDING GLASS FIBERS AND METHOD FOR USING SAME

BACKGROUND OF THE INVENTION

The present invention relates to a helically wound forming tube for use in a method of forming glass fiber and to a method of forming glass fiber.

Although the process of making glass fiber will be explained in somewhat more detail hereinafter, such a process can basically be summarized as involving the winding of a glass fiber strand around a rotating forming tube which must be both strong and flexible. After the winding is completed, the glass fiber is further processed, and then the forming tube is partially collapsed and extracted from the interior of the circular glass fiber windings so that the strand can be unwound by grasping the interior lead end. Because of the method of processing glass fiber and the types of steps employed, the forming tube must have good wet strength and be resistant to both heat and centrifugal forces.

Prior art forming tubes comprise a helically wound tube employing three or more plies of kraft paper, each ply containing a spiral butt joint, i.e., each edge of the ply, or strip of paper, in each ply, or layer, abuts the adjacent edge. The spiral butt joints were staggered for strength purposes.

These prior art forming tubes are made by helically winding separate plies of paper around a stationary mandrel as is well known in the art and represented by U.S. Pat. Nos. 3,165,034 and Re23,899. The forming tube was then conventionally treated with a silicone release agent to enable the tube to be more easily removed from the interior of the glass fiber strand circularly wound therearound.

A forming tube when used in forming glass fiber is located on a collet drive and rotated about the axis of the tube. The tube is brought up to speed before winding of the glass fiber commences. Heretofore, rotation speeds of 3,000–4,000 rpm have been used. Problems have arisen in the formation of glass fiber using more modern apparatus which has higher speeds. As the speed of the rotary winding step is increased, a stronger forming tube must employed. In fact, prior art tubes have not been usable at high speeds because the increased centrifugal forces cause them to rupture. However, the forming tube must still maintain the needed flexibility in order to be withdrawn from the center of the wound glass fiber and in order to maintain a low unit per use cost.

The same type of general process for forming helically wound tubes has been used to make rigid textile carriers such as that represented by U.S. Pat. No. 2,751,936 which has three inner plies of spiral butt joints and one outer ply with a spiral overlapped joint. The purpose of the spiral overlapped joint is to enable the tube to take on a smooth outer surface after the outer ply of a very thin paper was sanded or skived and treated with various compositions.

It is also known to provide spiral overlapped joints on both the inner and outer plies for various purposes such as mailing tubes, U.S. Pat. No. 726,894 and food containers, 3,183,802. U.S. Pat. No. 2,181,035 discloses spiral overlapped joints for intermediate and outer plies with an inner ply having a spiral butt joint for tubing used to insulate electrical conductors. The tube is stated to have an increased tensile strength with sufficient flexibility to be bent, twisted or collapsed without objectionable injury in order to achieve the desired accordian flexure of the plies required for insulating electrical conductors. These characteristics are stated to be achieved by providing at least one layer of a cellophane-type material having overlapped spiral joints and one or more layers of kraft paper together with one or more layers of crepe paper which also may have overlapped spiral joints. However, this patent relates to a tube for a totally nonanalogous use where accordion-type flexure is desired; furthermore, such a tube is not used under conditions where the tube is intentionally treated with an aqueous spray and then subjected to relatively high temperatures as in a glass fiber forming process. Additionally, this patent does not disclose the structure of the present invention whereby the spiral joint of the inner ply is reinforced by stacking the spiral overlapped joint of the outer ply thereabove.

SUMMARY OF THE INVENTION

In response to the above problems in the formation of glass fiber, the present invention provides a stronger forming tube and its use in a method of forming glass fiber while still maintaining a low unit per use cost. The forming tube is of a helically wound construction having a helically wound inner ply having a spiral joint, at least one helically wound intermediate ply having a spiral overlapped joint, and a helically wound outer ply having a spiral overlapped joint, wherein the overlapped joint of the outer ply is stacked above the spiral joint of the inner ply to reinforce the latter, and wherein the spiral overlapped joint(s) of the intermediate ply(s) is(are) staggered from (each other and) the other joints of the forming tube.

All of the plies are constructed from a good quality kraft paper giving the tube the requisite flexibility and having good wet strength and resistance to heat and centrifugal forces. The inner ply may have a spiral overlapped joint or, preferably, a spiral butt joint. The outer surface of the outer ply is treated with a conventional release agent to enable the forming tube to be more easily removed from the interior of the wound glass fiber by partially collapsing and extracting the tube from the interior of the wound fiber.

The use of this tube in the formation of glass fiber permits higher winding speeds while maintaining the necessary tube strength throughout processing.

DESCRIPTION OF DRAWINGS

Further advantages of the present invention will become apparent from the following detailed description made with reference to the accompanying drawings in which.

DETAILED DESCRIPTION OF PREFERRED EMBODIMENTS OF THE PRESENT INVENTION

Figure 1:
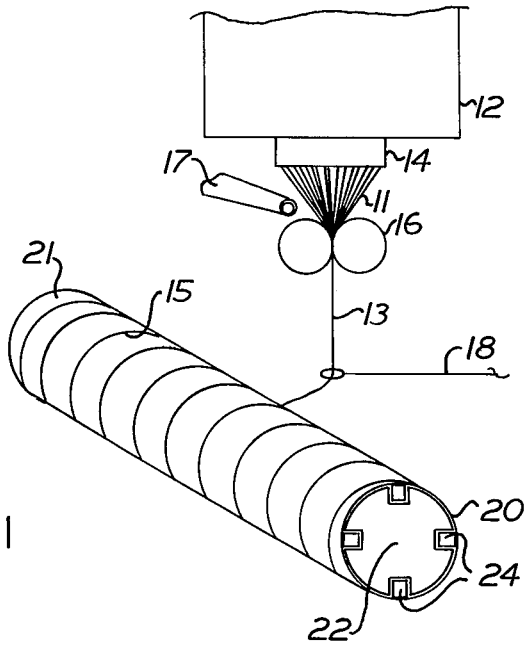
FIG. 1 is a schematic view showing the formation and winding of glass fiber.
Figure 2:
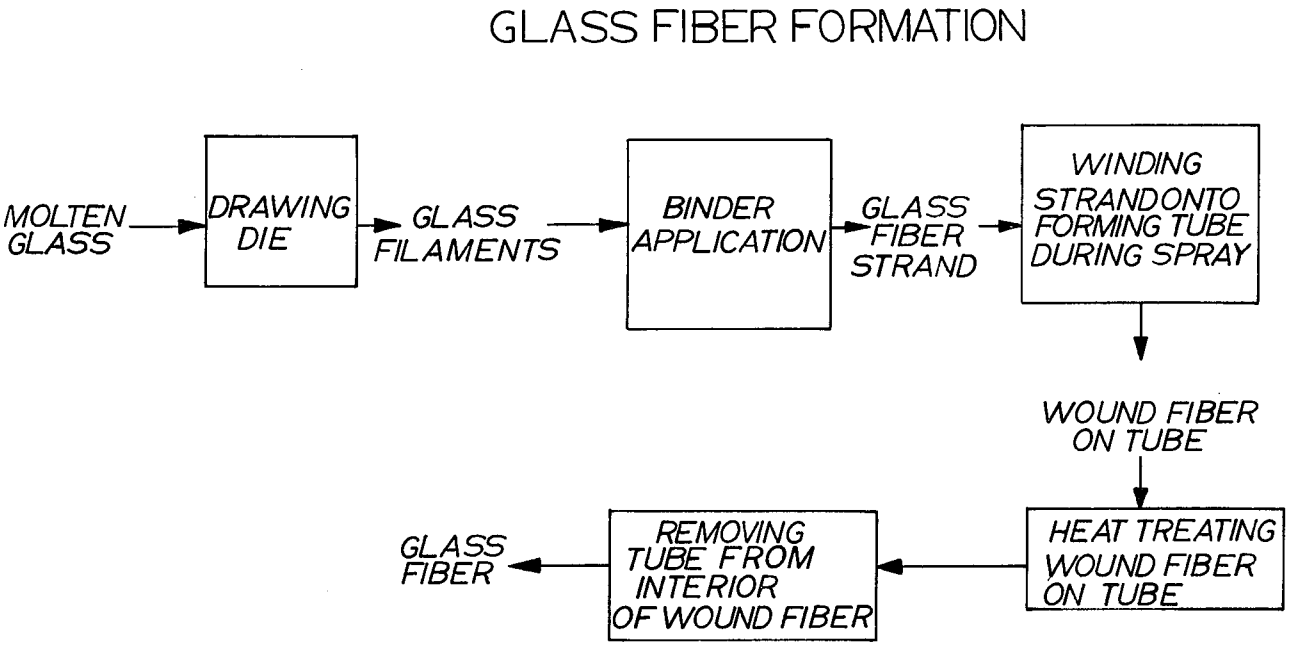
FIG. 2 represents a block diagram of the essential steps in the process of forming glass fiber.

With reference to FIG. 1 and the block diagram of FIG. 2, the method of forming glass fiber will now be described. Conventionally, apparatus necessary for forming glass fiber includes a furnace 12 supplying the necessary molten glass to a drawing die 14 having a multitude of holes therein for producing a corresponding number of very fine filaments 11. These filaments 11 are then formed into a single strand 13 by rollers 16 while a binder, or sizing, is applied to the filaments and strand in an aqueous solution by means of spray 17. As a result of the binder application, the forming tube is necessarily subjected to the aqueous binder solution during rotation because of the solution adhering to the strand and the spray falling on the tube. As is well known in the art, the binder is necessary to adhere the fine filaments together into strand 13 and to allow the glass fiber to adhere to rubber or to take on stains or colors as desired.

The glass fiber strand 13 is then controlled by traveler 18 so that the strand can be wound around the outer surface 21 of forming tube 20 with a more or less equal distribution. The forming tube 20 is rotated by any suitable rotary drive means; one such means being used in the industry is shown in FIG. 1 as a collet drive 22 which has a series of centrifugally actuated fingers 24. These fingers extend along the longitudinal axis of collet drive 22 and are spaced about the periphery. However, the centrifugally actuated fingers 24 are generally less than the length of forming tube 20. Thus, when the collet drive 22 is initially rotated, the centrifugal force acting upon fingers 24 forces them outwardly to engage the inner surface of forming tube 20. Collet drive 22 is in effect an expandable mandrel which allows the forming tube 20 to be placed on and removed from the drive 22 when it is at rest without the need for any other securing means.

The strength required for forming tubes is immediately apparent from the realization that collet drive 22 rotates anywhere from 3,000 to 8,000 rpm. The collet drive 22 is also subject to very severe acceleration which places great stress upon the forming tube 20. One example of a collet drive in operation in the fiber industry is one having a diameter of approximately 12 inches and a length of about 4 feet which proceeds from rest to about 6,000 rpm in about 9 seconds. As collet drive 22 rotates actuating the fingers 24, stresses are also placed on the inner peripheral portions of the tube 20 between the fingers 24 and at the ends of the fingers 24 which are shorter in length than the tube 20. In addition to these stresses, the tube must have the strength and integrity to last at least one use, and preferably more, one use consisting of about 1 hour of continuous rotation.

After generally about one hour, a sufficient amount of glass fiber 15 is wound in generally circular fashion about the outer periphery of forming tube 20. At this point the collet drive 22 is stopped, which in turn allows fingers 24 to resume their rest condition. Forming tube 20 and the glass fiber wrapped around its periphery are then removed as a unit and placed into a heated oven to dry the binder that was sprayed onto the fiber strand 13.

After oven drying, forming tube 20 is removed from the interior of the circularly wound glass fiber by partially collapsing the tube and extracting it from the glass fiber windings. Then the interior lead strand is located for winding onto bobbins or directly into fabric.

Thus, from the foregoing, it is apparent that forming tubes used in the glass fiber industry must have a flexible structure but yet be strong enough to withstand the centrifugal forces of rotation on the collet drive. The forming tube must also have good wet strength because of the aqueous spray. The forming tube must also have good heat resistance because of its presence in the oven during the drying of the glass fiber. Finally, the tube must be of such a durability that it can be reused.

Figure 3:
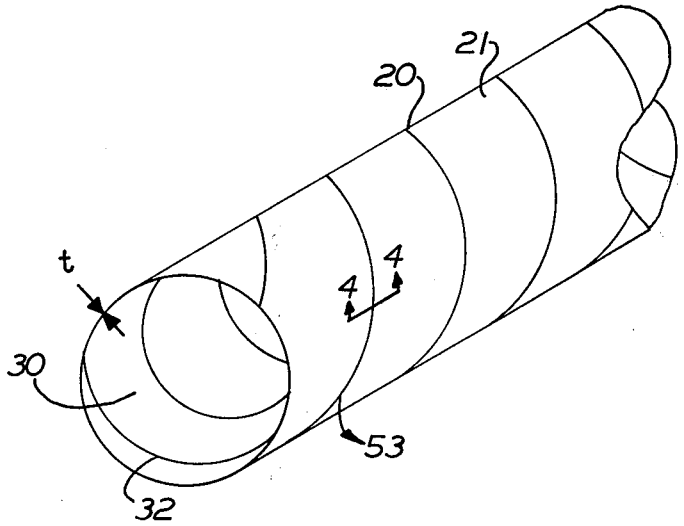
FIG. 3 shows a perspective view of the forming tube of the present invention.

With reference to FIG. 3, a three-ply forming tube 20 of the present invention has an outer surface 21 formed by the outer ply which has a spiral overlapped joint 53. The spiral joint 32 of the inner ply 30 can be a spiral overlapped joint or, preferably, a spiral butt joint. The inside ply can be overlapped on itself to form the overlapped joint as shown in U.S. Pat. No. 3,165,034 but the spiral butt joint is preferred for ease of manufacture. Tube 20 has a thickness "$t$" selected from the range of 0.020 to 0.060 inches and an overall tube diameter greater than 6 inches.

Figure 4:
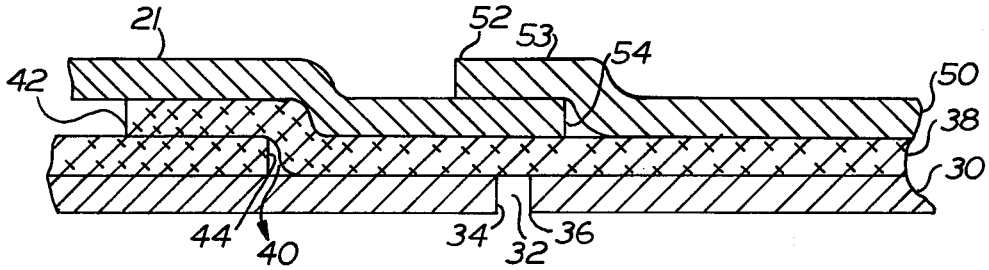
FIG. 4 shows a partial cross section of a three-ply forming tube of the present invention along lines 4—4 of FIG. 3.

FIG. 4 shows a cross section of a portion of the tube shown in FIG. 3. Inner ply 30 is formed to have a spiral butt joint 32 which is shown with a slight gap as is generally the case in view of the difficulty in precisely abutting the adjacent edges 34 and 36 of the ply. Because of the difficulty in controlling the position of the ply, overlapping at the intended abutment joint 32 can accidentially occur. As is customary in this art one strip of paper is used to form one layer in the final tube construction, and both the strip of paper and the final layer are referred to as a ply. As is also customary in the formation of helically wound tubes, adhesive, which is not illustrated in the drawings for the sake of clarity, is applied to the lower surface of each ply before it is wrapped around the stationary mandrel.

The intermediate ply 38 of the three-ply structure shown in FIG. 4 has a spiral overlapped joint 40 where the leading edge 42 overlaps the trailing edge 44 of the intermediate ply. Similarly, the outer ply 50 has an overlapped spiral joint 53 formed by leading edge 52 overlapping trailing edge 54.

In addition to the overlapping of the intermediate ply 38 and the outer ply 50 to provide strength, another important feature of the present invention resides in the location of the joints of the plies. The spiral overlapped joint 40 of the intermediate ply 38 is positioned so that it is staggered away from the abutment joint 32 of the inner ply 30 and the overlapped joint 53 of the outer ply 50. Any additional overlapped joint of any additional intermediate ply would also be staggered from the spiral overlapped joints of the other intermediate plies and also from the spiral overlapped joint of the outer ply and the spiral joint of the inner ply. However, in order to strengthen the weakness produced by the spiral butt joint 32 of the inner ply 30, spiral overlapped joint 53 of outer ply 50 is stacked or placed directly over the spiral butt joint 32 of the inner ply. Maximum reinforcement is achieved when the trailing edge 54 of the spiral overlapped joint of the outer ply 50 is extended to cover the entire spiral butt joint by extending beyond the leading edge 36 of the spiral butt joint of the inner ply 30. Similarly, the leading edge 52 of the spiral overlapped joint 53 of the outer ply 50 is positioned so that it also overlaps the entire spiral butt joint 32 of the inner ply 30 by extending beyond the trailing edge 34 of the spiral butt joint 32.

Figure 5:
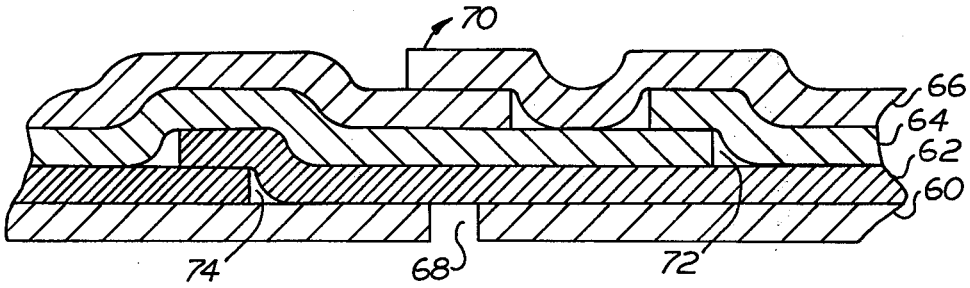
FIG. 5 shows a similar cross section as that shown in FIG. 3 for a four-ply construction.

In FIG. 5, a four-ply structure is represented in accordance with the teachings of the present invention and comprises inner ply 60, intermediate plies 62 and 64, and outer ply 66. Inner ply 60 has a spiral butt joint 68 stacked underneath a spiral overlapped joint 70 of the outer ply 66. Spiral overlapped joint 72 of the second intermediate ply 64 and spiral overlapped joint 74 of the first intermediate ply 62 are staggered from each other and from spiral butt joint 68 and from overlapped joint 70 to provide maximum strength for the forming tube.

The structures shown in FIGS. 4 and 5 are somewhat exaggerated from the actual structure of the forming tube for purposes of clarity. The presence of the adhesive together with the thinness and compressibility of the paper tend to make the structure a more uniform laminate.

All of the plies of the forming tube according to the present invention are made from a good quality kraft paper selected from the range of 40 to 80 pounds. As is well known in the art, measurement of paper by pounds is based on the weight of a ream of paper of 500 sheets, each sheet being 24 × 36 inches. Various types of kraft paper can be used in the present invention, some examples being extensible, wet strength and multi-walled. A preferred form of the forming tube in accordance with the present invention has three or four plies made of 70 pound wet strength kraft paper.

The width of the ply used to make each individual ply is a matter of choice. However, it will be recognized that the width of the plies to be overlapped in the intermediate and outer plies will have to be greater than the width of the ply for the inner ply if the latter is to form a spiral butt joint and the former are to form spiral overlapped joints.

It is conventional to put a silicone release coating on the outer surface of a forming tube in order to aid removal of the forming tube from the interior windings of the glass fiber. The effectiveness of the silicone release agent is aided by employing wet strength kraft paper for at least the outer ply of the forming tube. The helically wound plies of the forming tube of the present invention can be wound with either a right or a left hand twist. However, regardless of whether a right or a left hand twist is employed, the leading edge of each ply will always overlap the trailing edge. Any suitable water-resistant adhesive can be used in the present invention. The water-resistant adhesive must be flexible and be able to withstand the aqueous spray during the formation of the glass fiber and also withstand the high temperatures during the oven drying. Some typical types of adhesive used are water-based adhesives which are treated to make them thermosetting and thus water resistant, such as formaldehyde treated dextrin and silicates. A preferred type of adhesive is tackified polyvinyl alcohol, disclosed in U.S. Pat. No. 3,135,648.

In summary, the two key factors explaining the increased strength of the forming tube of the present invention compared with a conventional forming tube of the same number of plys are first, overlapping of the intermediate ply or plies and the outer ply and, second, positioning the spiral overlapped joint of the outer ply directly above the spiral joint of the inner ply to strengthen the latter. The strength of forming tubes in accordance with the present invention has been demonstrated on glass fiber making machines having a collet drive on the order of 6,000 rpm. On such a machine conventionally used three-ply spiral butt joint forming tubes could not withstand the stresses applied and exploded in use. Similarly, conventional five-ply spiral butt joint forming tubes also exploded in use. However, on the same apparatus, forming tubes in accordance with the present invention having an inner spiral butt joint ply and intermediate and outer spiral overlapped joint plies have been successfully used for one or more uses.

What is claimed is:

1. A strong, flexible glass fiber carrier of a helically wound forming tube construction for supporting glass fiber thereon in generally circular windings during glass fiber processing and having good wet strength and resistance to heat and centrifugal forces, said carrier comprising a helically wound inner ply having a spiral joint, at least one helically wound intermediate ply having a spiral overlapped joint, a helically wound outer ply having a spiral overlapped joint and an outer surface, and a release coating on the outer surface of said outer ply to enable said carrier to be easily removed from glass fiber wound around the outer surface of said outer ply by partially collapsing and extracting said carrier from the interior of the fiber, said intermediate and outer plies having a water-resistant adhesive across their entire inner surfaces, the spiral overlapped joint of said outer ply being stacked above the spiral joint of said inner ply to reinforce the latter, the spiral overlapped joint of said intermediate ply being staggered from the other joints of said carrier, each of said helically wound plies being formed of kraft paper selected from the range of 40 to 80 pounds, and said carrier having a wall thickness selected from a range of 0.020 to 0.060 inches and a diameter of at least 6 inches.

2. A carrier as claimed in claim 1 wherein the spiral joint of said helically wound inner ply is a spiral butt joint.

3. A carrier as claimed in claim 1 wherein said carrier has at least two helically wound intermediate plies each having a spiral overlapped joint staggered from each other and the other joints of said carrier.

4. In a method of forming glass fiber comprising continuously drawing a multitude of glass filaments from a drawing die, forming said filaments into a glass fiber strand, applying a binder to said strand, winding said glass fiber strand onto a rotating forming tube, heat treating said glass fiber strand to dry said binder while said strand is wound around said forming tube, and removing said forming tube from the interior of the wound glass fiber strand by partially collapsing and extracting said tube, the improvement comprising employing a forming tube of a helically wound construction having a helically wound inner ply having a spiral joint, at least one helically wound intermediate ply having a spiral overlapped joint, a helically wound outer ply having a spiral overlapped joint, the spiral overlapped joint of said outer ply being stacked above the spiral joint of said inner ply to reinforce said joint of said inner ply, and the spiral overlapped joint of said intermediate ply being staggered from the other joints of said carrier.

5. In a method as claimed in claim 4 wherein said joint of said inner ply is a spiral butt joint.

6. A method as claimed in claim 4 wherein said forming tube has at least two intermediate plies each having a spiral overlapped joint staggered from each other and the other joints of said tube.

7. A method of making glass fiber utilizing a helically wound forming tube as a flexible glass fiber carrier and having at least three helically wound plies of kraft paper adhesively secured together with a water-resistant adhesive, and where the tube includes a helically wound inner ply having a spiral joint, at least one helically wound intermediate ply having a spiral overlapped joint, and a helically wound outer ply having a spiral overlapped joint, the spiral overlapped joint of said outer ply being stacked above the spiral joint of said inner ply to reinforce the latter, and the spiral overlapped joint of said intermediate ply being staggered from the other joints of said carrier, and said method comprising continuously drawing a multitude of glass filaments from a drawing die, forming said filaments into a single glass fiber strand, applying a binder to said fiber strand, locating said tube in surrounding relation with a drive for rotating the tube, rotating said tube by engaging the helically wound inner ply with the rotary drive means, winding said glass fiber strand around the outer surface of the helically wound outer ply of said tube, and effecting said winding so that said strand intersects and overlies the overlapped joints of said intermediate and outer plies.

8. A method as claimed in claim 7 wherein said inner ply has a spiral butt joint, and said tube is accelerated to over 3,000 rpm within about 9 seconds.

9. A method as defined in claim 8 further including the steps of heat treating said glass fiber strand to dry said binder while said strand is wound around said forming tube, and removing said forming tube from the interior of the wound glass fiber strand by partially collapsing and extracting said tube.

10. A method as claimed in claim 7 wherein said forming tube has at least two intermediate plies, each having a spiral overlapped joint staggered from each other and the other joints of said tube.

* * * * *